US007642878B2

(12) United States Patent
Park et al.

(10) Patent No.: US 7,642,878 B2
(45) Date of Patent: Jan. 5, 2010

(54) PLURAL SIGNAL TRANSMISSION LINE CIRCUITS HAVING A REFERENCE PLANE WITH SEPARATION SLOTS THEREIN CORRESPONDING TO THE PLURAL SIGNAL TRANSMISSION LINES

(75) Inventors: Kwang-soo Park, Suwon-si (KR); Jong-hoon Kim, Hwaseong-si (KR); Jae-jun Lee, Seongnam-si (KR)

(73) Assignees: Samsung Electro-Mechanics Co., Ltd., Gyeonggi-do (KR); Rensselaer Polytechnic Institute, Troy, NY (US)

( * ) Notice: Subject to any disclaimer, the term of this patent is extended or adjusted under 35 U.S.C. 154(b) by 23 days.

(21) Appl. No.: 11/812,583

(22) Filed: Jun. 20, 2007

(65) Prior Publication Data

US 2008/0061900 A1 Mar. 13, 2008

(30) Foreign Application Priority Data

Sep. 13, 2006 (KR) ..... 10-2006-0088694

(51) Int. Cl.
*H01P 3/08* (2006.01)

(52) U.S. Cl. ..... 333/1; 333/5; 333/238

(58) Field of Classification Search ..... 333/1, 333/238, 4, 5

See application file for complete search history.

(56) References Cited

U.S. PATENT DOCUMENTS

| | | | | |
|---|---|---|---|---|
| 4,608,557 | A * | 8/1986 | Nakanishi et al. | 345/440.2 |
| 5,479,138 | A * | 12/1995 | Kuroda et al. | 333/1 |
| 6,590,466 | B2 * | 7/2003 | Lin et al. | 333/1 |
| 7,102,456 | B2 * | 9/2006 | Berg | 333/4 |

FOREIGN PATENT DOCUMENTS

| | | |
|---|---|---|
| JP | 08-237007 | 9/1996 |
| JP | 2001-102817 | 4/2001 |
| JP | 2002-299440 | 10/2002 |

* cited by examiner

*Primary Examiner*—Benny Lee
(74) *Attorney, Agent, or Firm*—Harness, Dickey & Pierce

(57) ABSTRACT

A signal transmission circuit and method thereof are provided. The signal transmission circuit may include a plurality of signal transmission lines, each of the plurality of signal transmission lines configured to transfer data via signal currents and a reference transmission plane configured to transfer return currents corresponding to the signal currents, the reference transmission plane separated from each of the plurality of signal transmission lines by an insulating layer, the reference transmission plane including at least one separation slot.

24 Claims, 10 Drawing Sheets

PLURAL SIGNAL TRANSMISSION LINE CIRCUITS HAVING A REFERENCE PLANE WITH SEPARATION SLOTS THEREIN CORRESPONDING TO THE PLURAL SIGNAL TRANSMISSION LINES

PRIORITY STATEMENT

This application claims the benefit of Korean Patent Application No. 10-2006-0088694, filed on Sep. 13, 2006, in the Korean Intellectual Property Office, the disclosure of which is incorporated herein in its entirety by reference.

BACKGROUND OF THE INVENTION

1. Field of the Invention

Example embodiments of the present invention relate generally to a signal transmission circuit and method thereof.

2. Description of the Related Art

A micro strip line pattern or a strip line pattern may be provided to control transmission characteristics of a signal transmission circuit. In conventional micro strip line structures, a reference transmission plane having a ground voltage or a power voltage may be located under a signal transmission line. In conventional strip line structures, a plurality of reference transmission planes may be respectively arranged on and under a plurality of signal transmission lines. The signal transmission lines and the reference transmission planes of the strip line structures may be electrically separated from each other by a plurality of insulating layers. The transmission characteristics of the signal transmission circuits may be adjusted via the pattern of the signal transmission lines or the reference transmission planes.

FIG. 1 is a perspective view of a conventional signal transmission circuit. The signal transmission circuit of FIG. 1 may include a plurality of first through fifth signal transmission lines SL1, SL2, SL3, SL4 and SL5 and a plurality of reference transmission planes RP1 and RP2, and a plurality of insulating layers D1, D2 and D3. The plurality of first through fifth signal transmission lines SL1, SL2, SL3, SL4 and SL5 may be formed from a plurality of metal layers, the plurality of reference transmission planes RP1 and RP2 may be formed from a plurality of metal layers.

FIG. 2 illustrates a portion of the first and second signal transmission lines SL1 and SL2 and the reference transmission plane RP1 of FIG. 1. Interference (e.g., cross-talk) between neighboring signal transmission lines will now be explained with reference to FIG. 2.

Referring to FIG. 2, the first signal transmission line SL1 may transmit a first signal current Is1 and the second signal transmission line SL2 may transmit a second signal current Is2. The reference transmission plane RP1 may transmit a return current Ir1 corresponding to the first signal current Is1 and a return current Ir2 corresponding to the second signal current Ir2.

Referring to FIG. 2, in the reference transmission plane RP1, electromagnetic wave noise Nw accompanying the return current Ir1 may affect the second signal current Is2 and electromagnetic wave noise Nw accompanying the return current Ir2 may affect the first signal current Is1, thereby resulting in cross-talk between the first and second signal transmission lines SL1 and SL2. Further, if a higher-frequency signal is transmitted through the signal transmission lines, the cross-talk may increase, which may further degrade system performance.

SUMMARY OF THE INVENTION

An example embodiment of the present invention is directed to a signal transmission circuit, including a plurality of signal transmission lines, each of the plurality of signal transmission lines configured to transfer data via signal currents and a reference transmission plane configured to transfer return currents corresponding to the signal currents, the reference transmission plane separated from each of the plurality of signal transmission lines by an insulating layer, the reference transmission plane including at least one separation slot.

Another example embodiment of the present invention is directed to a method of operating a signal transmission circuit, including forming a plurality of signal transmission lines, each of the plurality of signal transmission lines configured to transfer data via signal currents and forming a reference transmission plane configured to transfer return currents corresponding to the signal currents, the reference transmission plane separated from each of the plurality of signal transmission lines by an insulating layer, the reference transmission plane including at least one separation slot.

Another example embodiment of the present invention is directed to a signal transmission circuit including separation slots formed in a reference transmission plane to reduce cross-talk between neighboring signal transmission lines.

BRIEF DESCRIPTION OF THE DRAWINGS

The accompanying drawings are included to provide a further understanding of the invention, and are incorporated in and constitute a part of this specification. The drawings illustrate example embodiments of the present invention and, together with the description, serve to explain principles of the present invention.

DETAILED DESCRIPTION OF EXAMPLE EMBODIMENTS

Figure 1:
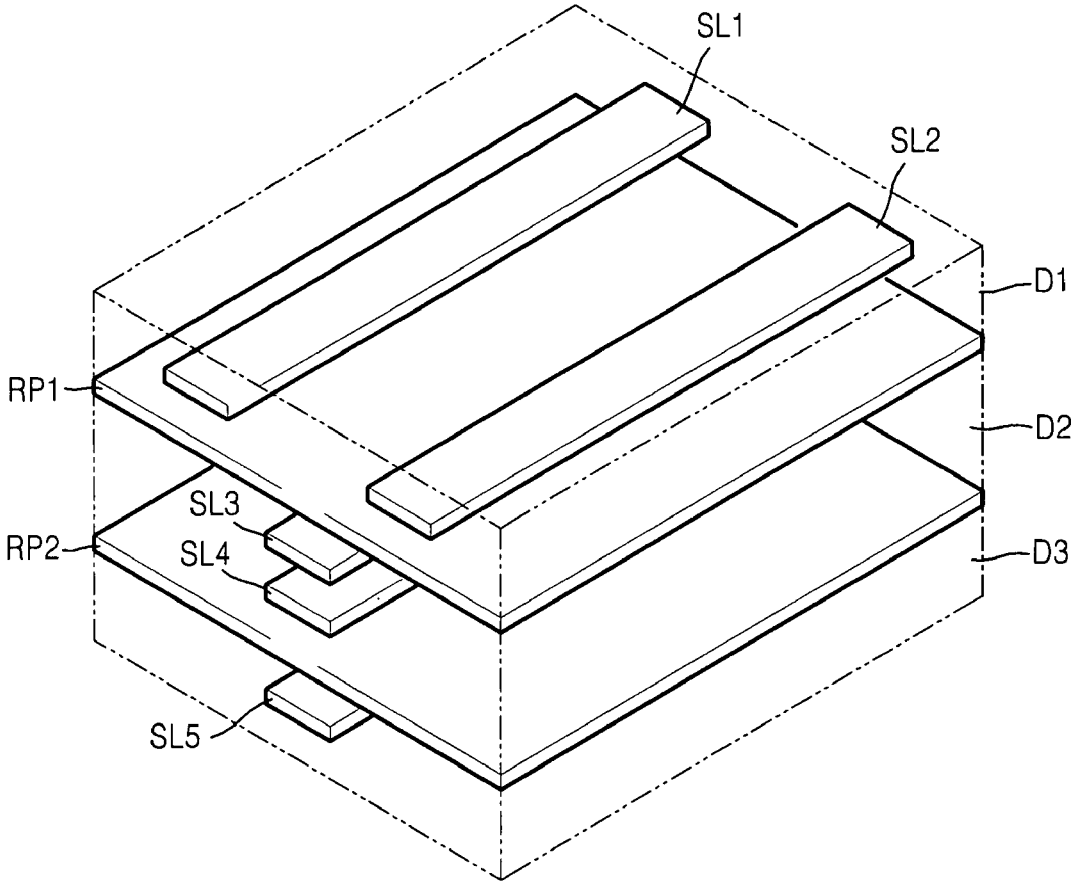
FIG. 1 (CONVENTIONAL ART)
FIG. 1 is a perspective view of a conventional signal transmission circuit.

Detailed illustrative example embodiments of the present invention are disclosed herein. However, specific structural and functional details disclosed herein are merely representative for purposes of describing example embodiments of the present invention. Example embodiments of the present invention may, however, be embodied in many alternate forms and should not be construed as limited to the embodiments set forth herein.

Accordingly, while example embodiments of the invention are susceptible to various modifications and alternative forms, specific embodiments thereof are shown by way of example in the drawings and will herein be described in detail. It should be understood, however, that there is no intent to limit example embodiments of the invention to the particular forms disclosed, but conversely, example embodiments of the invention are to cover all modifications, equivalents, and alternatives falling within the spirit and scope of the invention. Like numbers may refer to like elements throughout the description of the figures and such like numbers may not be described in all drawing figures in which they appear.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. Conversely, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 3:
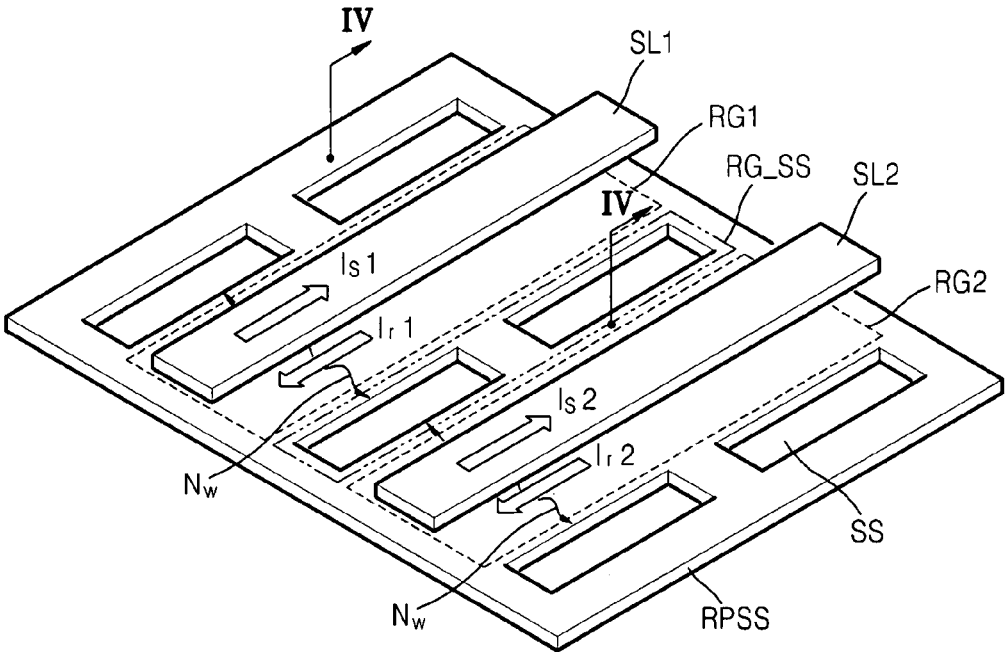
FIG. 3 illustrates a signal transmission circuit according to an example embodiment of the present invention.

FIG. 3 illustrates a signal transmission circuit according to an example embodiment of the present invention.

In the example embodiment of FIG. 3, the signal transmission circuit may include a first signal transmission line SL1 transmitting a first signal current Is1, a second signal transmission line SL2 transmitting a second signal current Is2, and a reference transmission plane RPSS having a plurality of separation slots SS.

In the example embodiment of FIG. 3, the first and second signal transmission lines SL1 and SL2 may be formed from a first metal layer and the reference transmission plane RPSS may be formed from a second metal layer (e.g., different from the first metal layer). The first metal layer forming the first and second signal transmission lines SL1 and SL2 may be electrically separated from the second metal layer forming the reference transmission plane RPSS by an insulating layer (not shown). The reference transmission plane RPSS may maintain a given voltage (e.g., a ground voltage or a power voltage) with respect to the first and second signal transmission lines SL1 and SL2.

In the example embodiment of FIG. 3, the first and second signal currents Is1 and Is2 of the first and second signal transmission lines SL1 and SL2 may include data information. For example, the first signal current Is1 may represent first data and the second signal current Is2 may represent second data (e.g., different from the first data). A return current Ir1 corresponding to the first signal current Is1 and a return current Ir2 corresponding to the second signal current Is2 may be transmitted through the reference transmission plane RPSS.

In the example embodiment of FIG. 3, the reference transmission plane RPSS may be divided into a region RG1 corresponding to the first signal transmission line SL1, a region RG2 corresponding to the second signal transmission line SL2, a region RG_SS between the first and second signal transmission lines SL1 and SL2, and the regions RG1 and RG2. In an example, the path of the return current Ir1 corresponding to the first signal current Is1 may be formed in the region RG1 corresponding to the first signal transmission line SL1, the path of the return current Ir2 corresponding to the second signal current Is2 may be formed in the region RG2 corresponding to the second signal transmission line SL2, and the plurality of separation slots SS may be located in the region RG_SS between the first and second signal transmission lines SL1 and SL2. As illustrated in the example embodiment of FIG. 3, the plurality of separation slots SS may be formed in parallel with neighboring signal transmission lines (e.g., in parallel with the first and second signal transmission lines SL1 and SL2).

Figure 2:
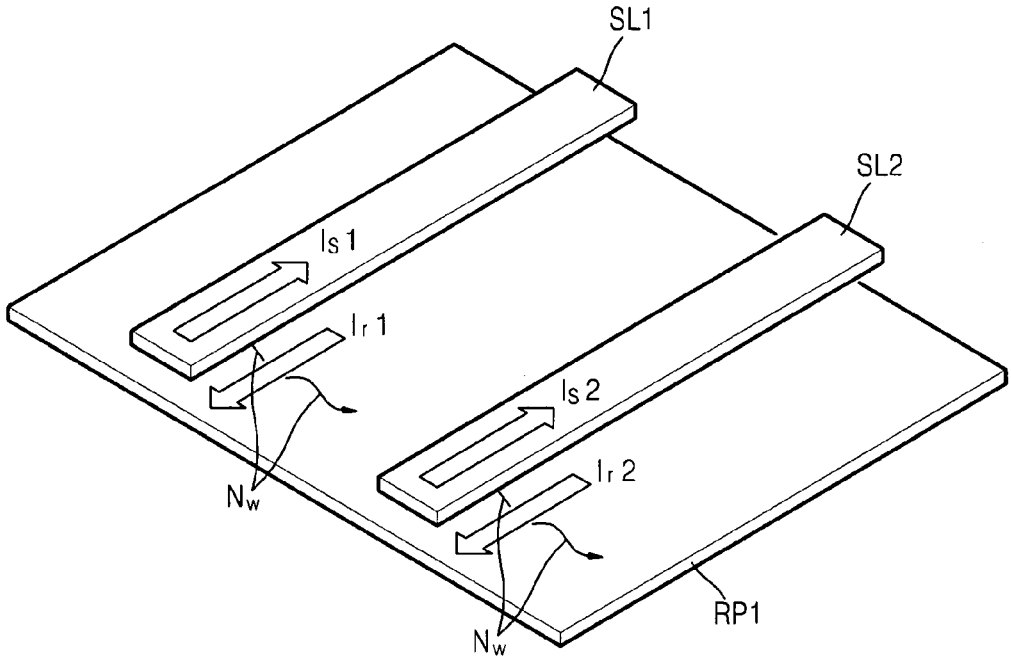
FIG. 2 (CONVENTIONAL ART)
FIG. 2 illustrates a portion of first and second signal transmission lines and a reference transmission plane of the conventional signal transmission circuit of FIG. 1.

In the example embodiment of FIG. 3, in an example, the plurality of separation slots SS included in the reference transmission plane RPSS may reduce cross-talk between the neighboring first and second signal transmission lines SL1 and SL2, for example, in comparison to the conventional signal transmission circuit illustrated in FIG. 2 (e.g., where cross-talk occurs) and reduce the influence of electromagnetic wave noise Nw accompanying the return current Ir1 on the second signal current Is2). Furthermore, the influence of electromagnetic wave noise Nw accompanying the return current Ir2 on the first signal current Is1 may also comparatively be decreased. Thus, in an example, the separation slots SS included in the reference transmission plane RPSS may operate as an electromagnetic wave noise reduction or blocking area. That is, the separation slots SS may partially separate the region RG1 corresponding to the first signal transmission line SL1 from the region RG2 corresponding to the second signal transmission line SL2 to reduce cross-talk between the first and second signal transmission lines SL1 and SL2 (e.g., which may be adjacent to each other). Also, as illustrated in FIG. 3, for example, it is understood that the separation slots SS may be arranged on both sides of a given signal transmission line (e.g., SL1, SL2, etc.). For example, at an "end" signal transmission line (e.g., the last signal transmission line in a particular arrangement), the separation slots SS may be arranged on both sides of the end signal transmission line even thought the separation slots SS are not necessarily "between" neighboring signal transmission lines.

Example operation of the separation slots SS included in the reference transmission plane RPSS will be described in greater detail below with reference to the example embodiment of FIG. 4.

Figure 4:
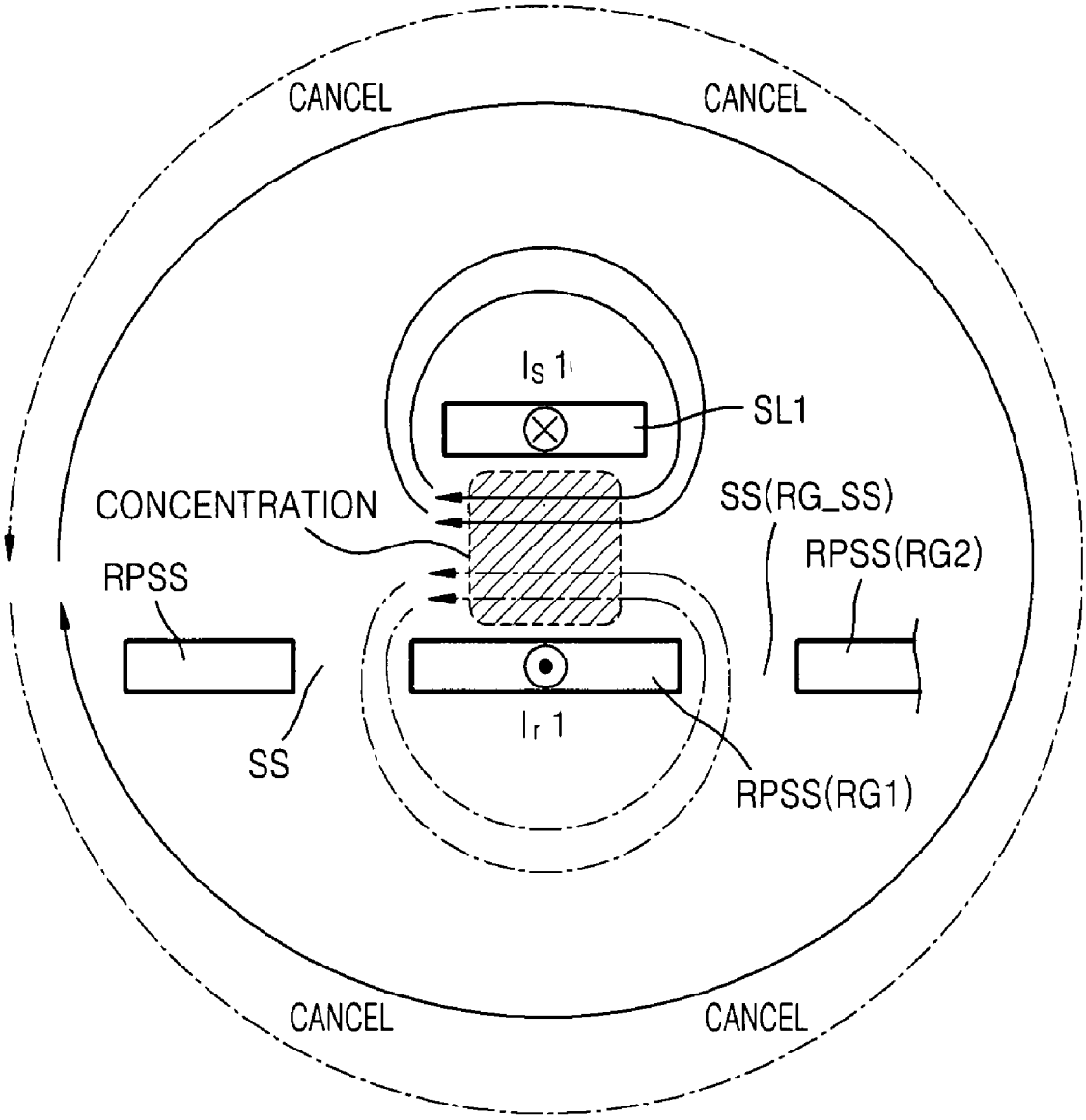
FIG. 4 illustrates a cross sectional view taken along line IV-IV of the signal transmission circuit of FIG. 3 according to another example embodiment of the present invention.

FIG. 4 illustrates a cross sectional view taken along line IV-IV of the signal transmission circuit of FIG. 3 according to another example embodiment of the present invention.

In the example embodiment of FIG. 4, a magnetic flux induced by the first signal current Is1 transmitted through the first signal transmission line SL1 may be represented by a solid line and a magnetic flux induced by the return current Ir1 transmitted through the region RG1 corresponding to the first signal transmission line SL1 may be represented by a dashed line.

In the example embodiment of FIG. 4, magnetic fluxes of the first signal current Is1 and magnetic fluxes of the return current Ir1 may correspond to each other in the region between the first signal transmission line SL1 and the region RG1, and a flux concentration effect illustrated as "CONCENTRATION" in FIG. 4 may occur. However, magnetic fluxes of the first signal current Is1 and magnetic fluxes of the return current Ir1 may be opposite to each other in the regions other than the region between the first signal transmission line SL1 and the region RG1, which may induce a flux cancellation effect illustrated as "CANCEL" in FIG. 4. The flux concentration effect CONCENTRATION occurring in the region between the first signal transmission line SL1 and the region RG1 may be strengthened due to the separation slots SS in the reference transmission plane RPSS. The first signal transmission line SL1 may consider the reference transmission plane RPSS as a transmission line RPSS (RG1). Thus, the first signal transmission line SL1 and the region RG1 from the reference transmission plane RPSS may function as a differential signal transmission line pair. Furthermore, a given amount (e.g., a majority) of energy within a transmitted signal may be concentrated in a space between a signal transmission line and a region of the reference transmission plane due to the flux concentration effect CONCENTRATION, and thus cross-talk between neighboring signal transmission lines may be further reduced.

Figure 5A:
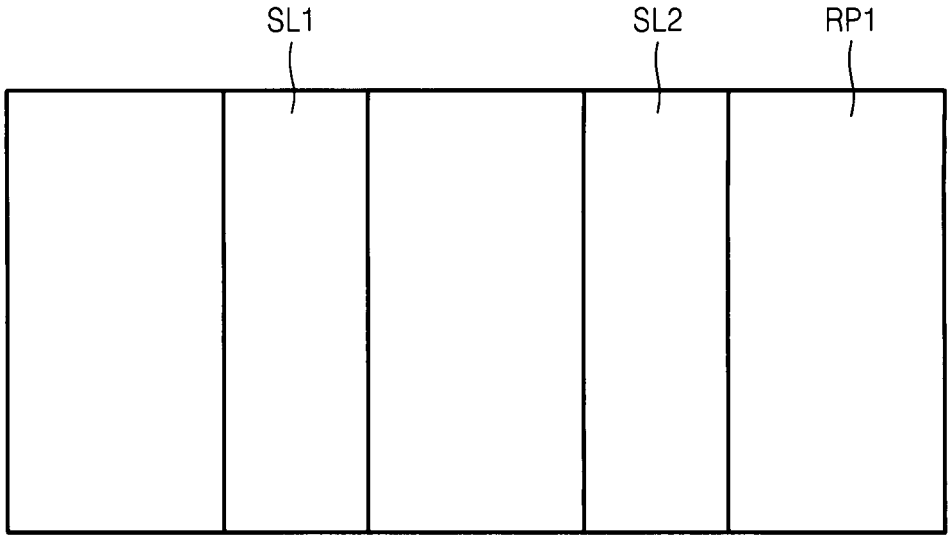
FIG. 5A (CONVENTIONAL ART)
FIG. 5A is a plan view of the conventional signal transmission circuit of FIG. 2.

FIG. 5A is a plan view of the conventional signal transmission circuit of FIG. 2.

Figure 5B:
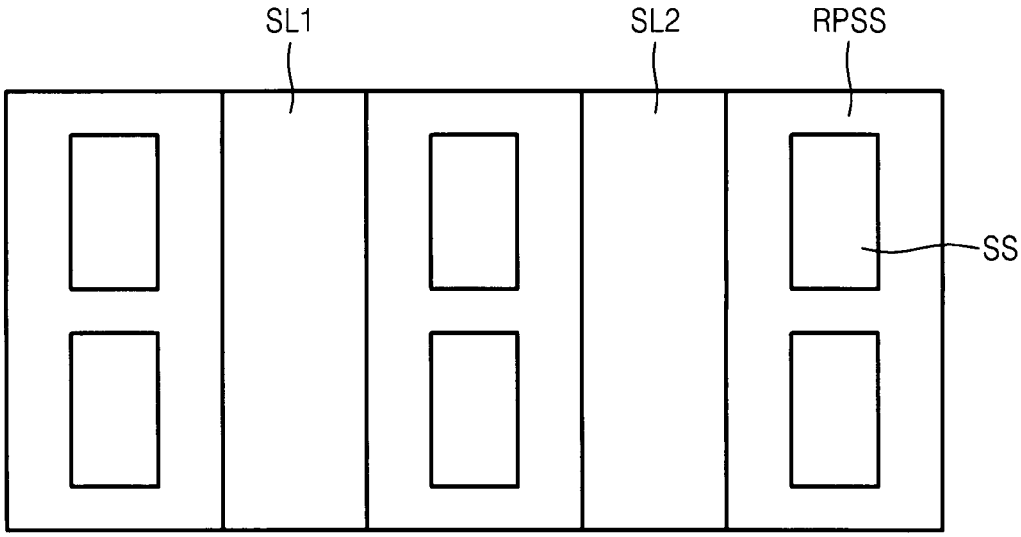
FIG. 5B is a plan view of the signal transmission circuit of FIG. 3 according to another example embodiment of the present invention.

FIG. 5B is a plan view of the signal transmission circuit of FIG. 3 according to another example embodiment of the present invention.

Figure 5C:
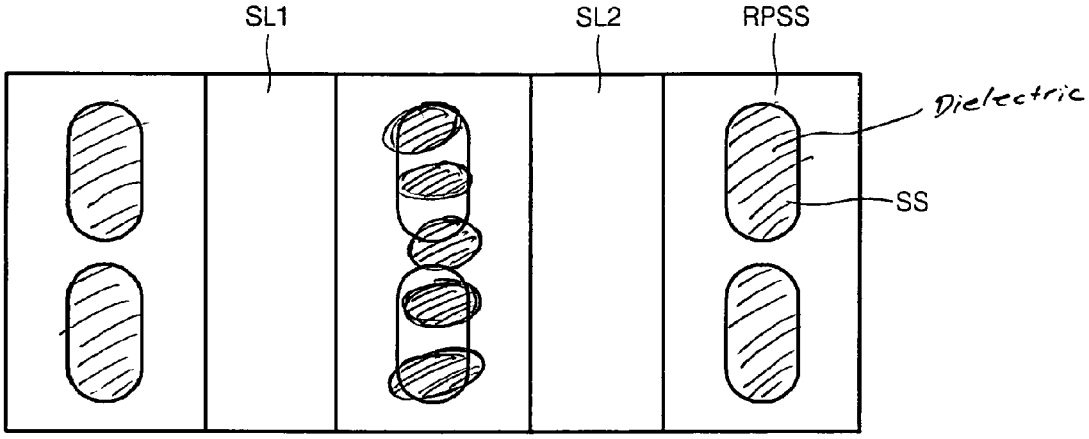
FIGS. 5C and 5D are plan views of signal transmission circuits according to other example, embodiments of the present invention.
Figure 5D:
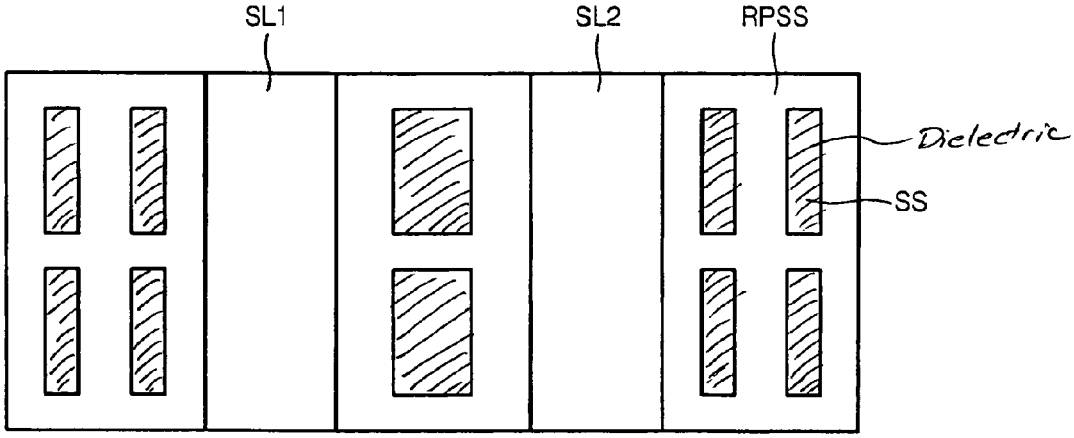

FIGS. 5C and 5D are plan views of signal transmission circuits according to other example embodiments of the present invention.

As shown in the example embodiments of FIGS. 5B, 5C and 5D, the horizontal cut faces of the plurality of separation slots SS included in the reference transmission plane RPSS may include any of a variety of shapes, such as, a polygon, a circle shown in FIG. 5C, oval shown in FIG. 5C, rectangle shown in FIG. 5B, etc. As illustrated in FIG. 5D, the plurality of separation slots SS may be formed in a single row or multiple rows in parallel with neighboring first and second signal transmission lines SL1 and SL2. In an example, the separation slots SS may be formed by cutting through the metal layer forming the reference transmission plane RPSS and may be filled with a material forming the insulating layer such as a dielectric substance shown as DIELECTRIC in FIGS. 5B, 5C and 5D.

Figure 6A:
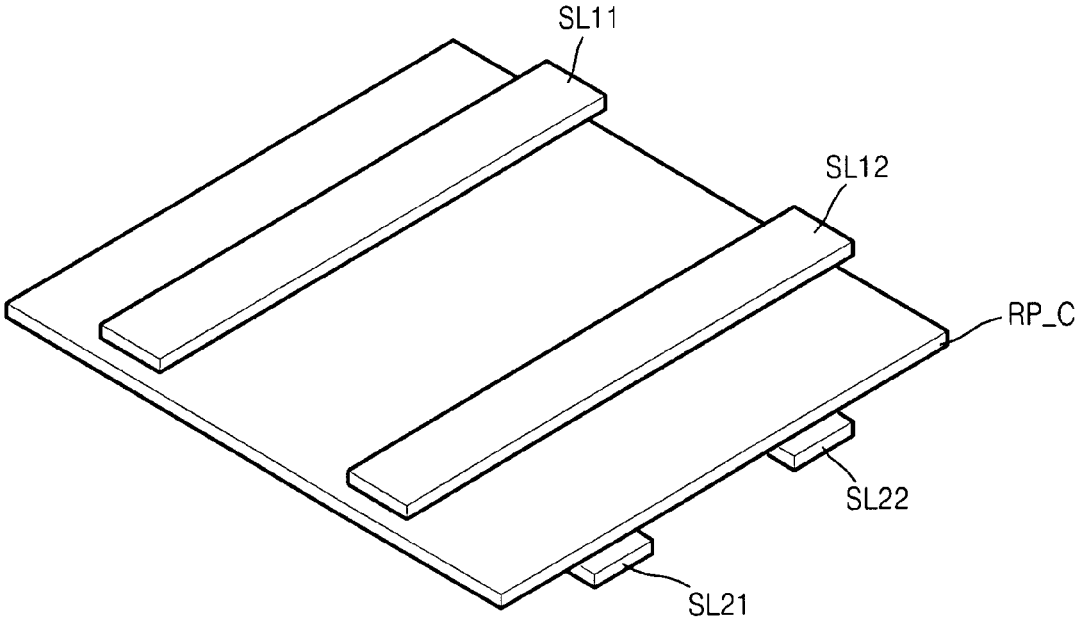
FIG. 6A (CONVENTIONAL ART)
FIG. 6A illustrates a signal transmission circuit including a conventional common reference transmission plane.

FIG. 6A illustrates a signal transmission circuit including a conventional common reference transmission plane RP_C.

Figure 6B:
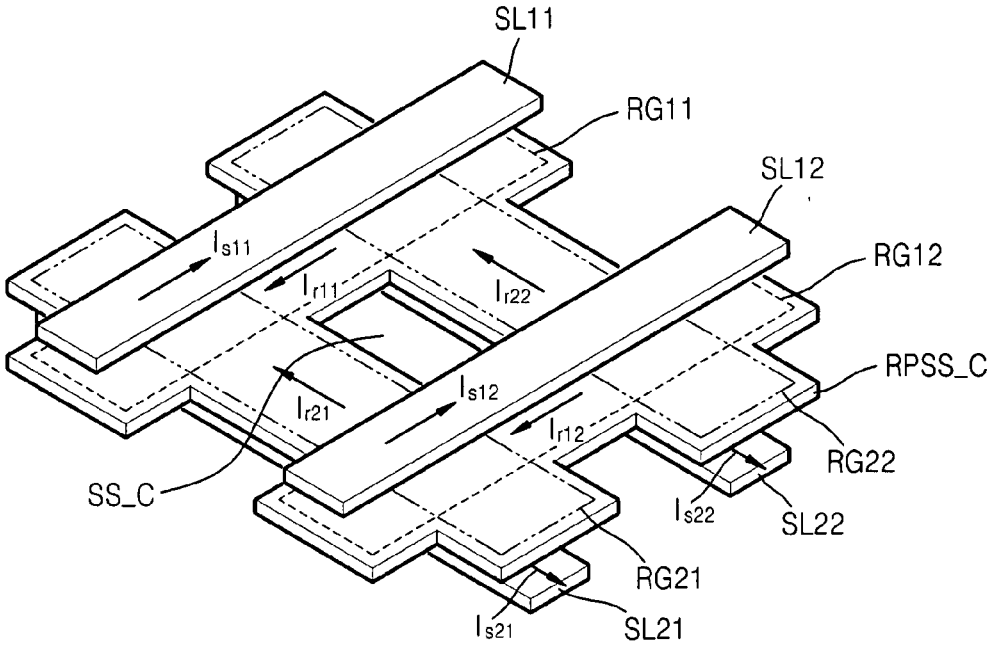
FIG. 6B illustrates a signal transmission circuit including a common reference transmission plane according to another example embodiment of the present invention.

FIG. 6B illustrates a signal transmission circuit including a common reference transmission plane RPSS_C according to another example embodiment of the present invention.

Referring to FIG. 6A and the example embodiment of FIG. 6B, the conventional common reference transmission plane RP_C illustrated in FIG. 6A and the common reference transmission plane RPSS_C illustrated in FIG. 6B may respectively function as a common reference transmission plane for a first signal transmission line SL11, a second signal transmission line SL12, a third signal transmission line SL21 and a fourth signal transmission line SL22. Thus, the conventional common reference transmission plane RP_C illustrated in FIG. 6A and the common reference transmission plane RPSS_C illustrated in FIG. 6B may maintain a given voltage (e.g., a ground voltage or a power voltage) with respect to the first, second, third and fourth signal transmission lines SL11, SL12, SL21 and SL22 and transmit corresponding return currents. However, the common reference transmission plane RPSS_C illustrated in FIG. 6B may include a plurality of common separation slots SS_C, whereas the conventional common reference transmission plane RP_C illustrated in conventional FIG. 6A may not include the common separation slots SS_C.

In the example embodiment of FIG. 6B, the first and second signal transmission lines SL11 and SL12 may be formed from a first metal layer, the third and fourth signal transmission lines SL21 and SL22 may be formed from a second metal layer, and the common reference transmission plane RPSS_C may be formed from a third metal layer located between the first and second metal layers. In an example, the first, second and third metal layers may be electrically separated from one another by insulating layers (not shown). The plurality of common separation slots SS_C may be formed in a manner such that the third metal layer may be at least partially cut through and a dielectric material (e.g., which may form the insulating layers) may be at least partially filled into the cut portion.

In the example embodiment of FIG. 6B, the plurality of common separation slots SS_C may occupy regions of the common reference transmission plane RPSS_C defined by a region between a region RG11 corresponding to the first signal transmission line SL11, a region RG12 corresponding to the second signal transmission line SL12, a region RG21 corresponding to the third signal transmission line SL21 and a region RG22 corresponding to the fourth signal transmission line SL22. The path of a return current Ir11 corresponding to a first signal current Is11 may be formed in the region RG11 corresponding to the first signal transmission line SL11, and the path of a return current Ir12 corresponding to a second signal current Is12 may be formed in the region RG12 corresponding to the second signal transmission line SL12. In addition, the path of a return current Ir21 corresponding to a third signal current Is21 may be formed in the region RG21 corresponding to the third signal transmission line SL21 and the path of a return current Ir22 corresponding to a fourth signal current Is22 may be formed in the region RG22 corresponding to the fourth signal transmission line SL22.

In the example embodiment of FIG. 6B, the common separation slots SS_C included in the common reference transmission plane RPSS_C may reduce cross-talk between the first and second signal transmission lines SL11 and SL12 caused by the return currents Ir11 and Ir12 and/or cross-talk between the third and fourth signal transmission lines SL21 and SL22 caused by the return currents Ir21 and Ir22.

Figure 7A:
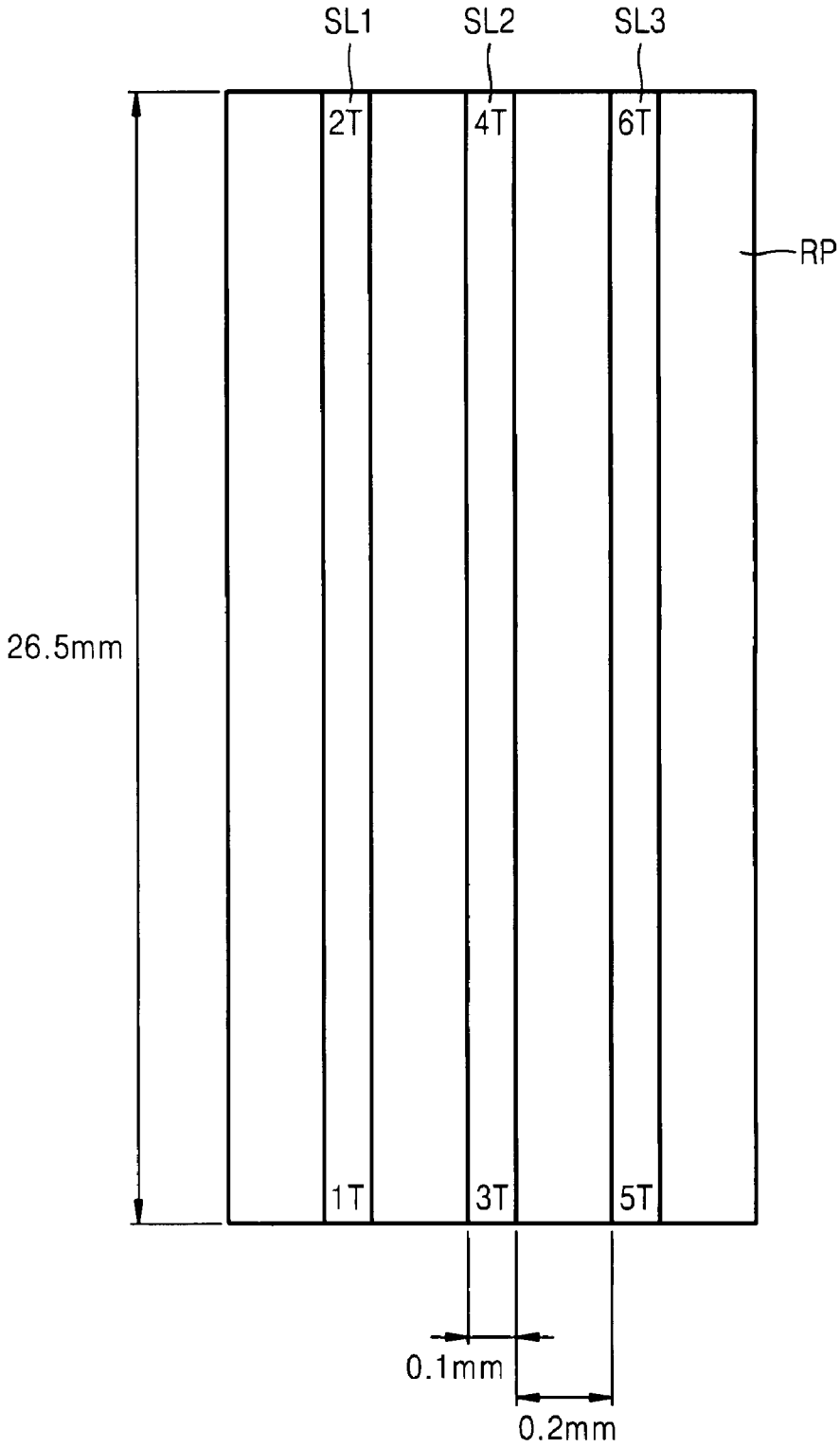
FIG. 7A (CONVENTIONAL ART)
FIG. 7A illustrates a conventional signal transmission circuit not including separation slots.

FIG. 7A illustrates a conventional signal transmission circuit not including separation slots. In particular, FIG. 7A illustrates signal transmission lines SL1, SL2 and SL3 and a reference transmission plane RP. In FIG. 7A, the length of the signal transmission lines is 26.5 mm, the width of the signal transmission lines is 0.1 mm, and the distance between the signal transmission lines is 0.2 mm.

Figure 7B:
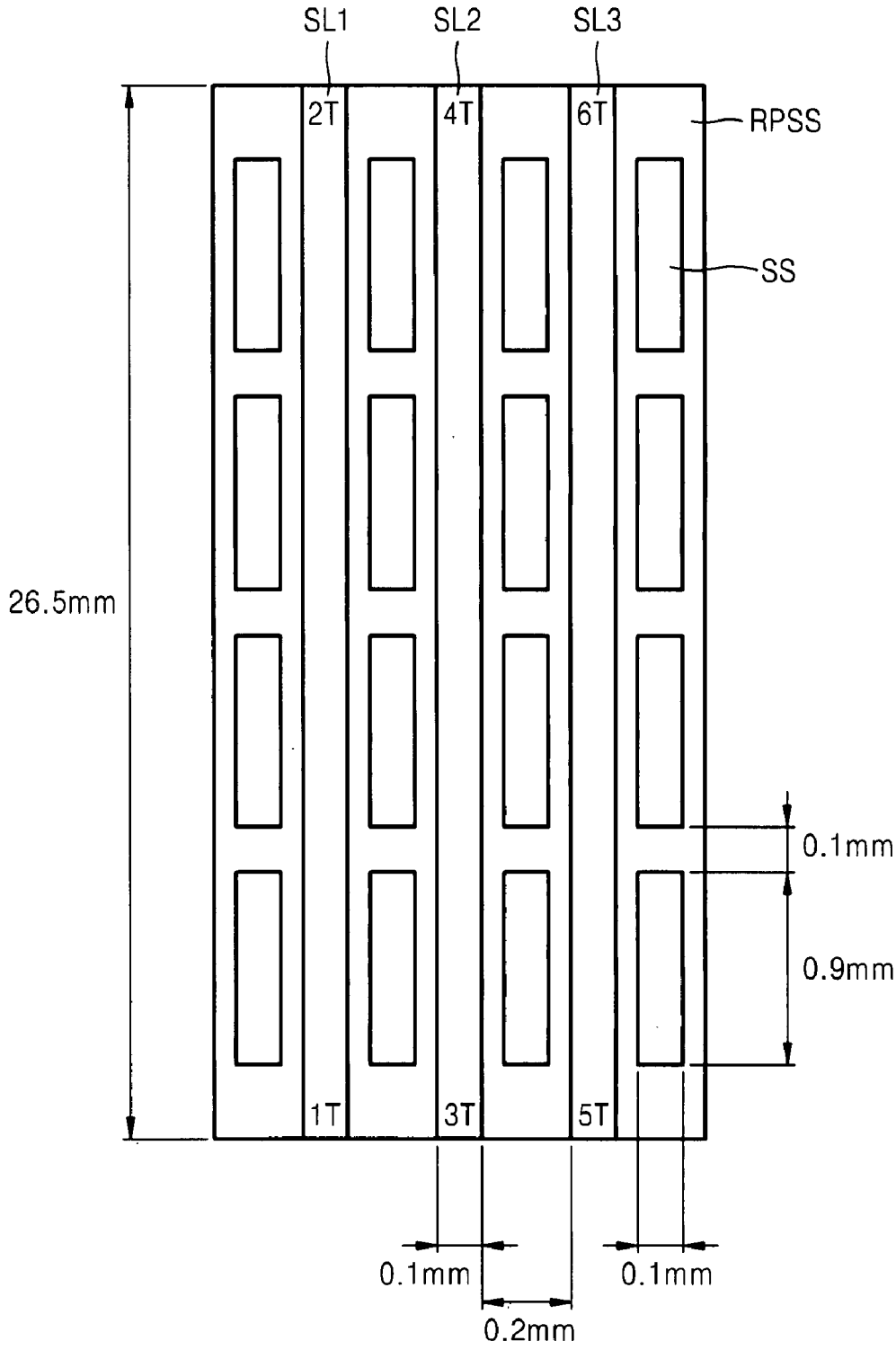
FIG. 7B illustrates a signal transmission circuit including separation slots according to another example embodiment of the present invention.

FIG. 7B illustrates a signal transmission circuit including separation slots according to another example embodiment of the present invention. FIG. 7B illustrates three signal transmission lines SL1, SL2 and SL3, a plurality of separation slots SS and a reference transmission plane RPSS. In FIG. 7B, the length of the signal transmission lines is 26.5 mm, the width of the signal transmission lines is 0.1 mm, the distance between the signal transmission line 0.2 mm, the length of the separation slots is 0.9 mm, the width of the separation slots is 0.1 mm, and the distance between the separation slots is 0.1 mm.

FIGS. 8A, 8B, 8C and 8D are graphs comparing S-parameters of the conventional signal transmission circuit illustrated in FIG. 7A to S-parameters of the signal transmission circuit illustrated of FIG. 7B. In FIGS. 8A, 8B, 8C and 8D, the horizontal axis ("x-axis") represents frequency FREQ [GHz] and the vertical axis("y-axis") represents the magnitude of an S-parameter [dB] i.e. S43 [dB] in FIG. 8A, S33[dB] in FIG. 8B, S13[dB] in FIG. 8C, and S23[dB] in FIG. 8D.

Figure 8A:
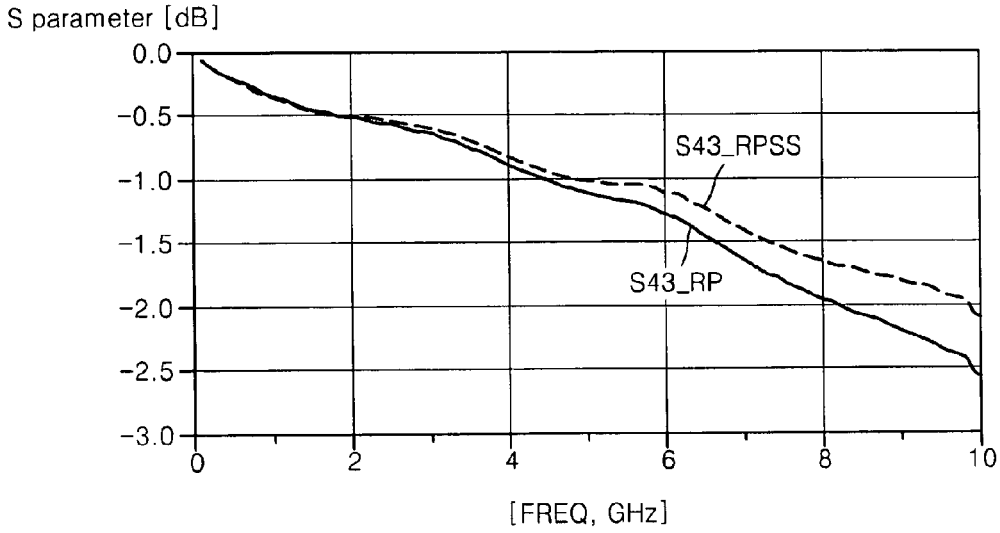
FIGS. 8A, 8B, 8C and 8D are graphs comparing S-parameters of the conventional signal transmission circuit illustrated in FIG. 7A to S-parameters of the signal transmission circuit illustrated of FIG. 7B.
Figure 8B:
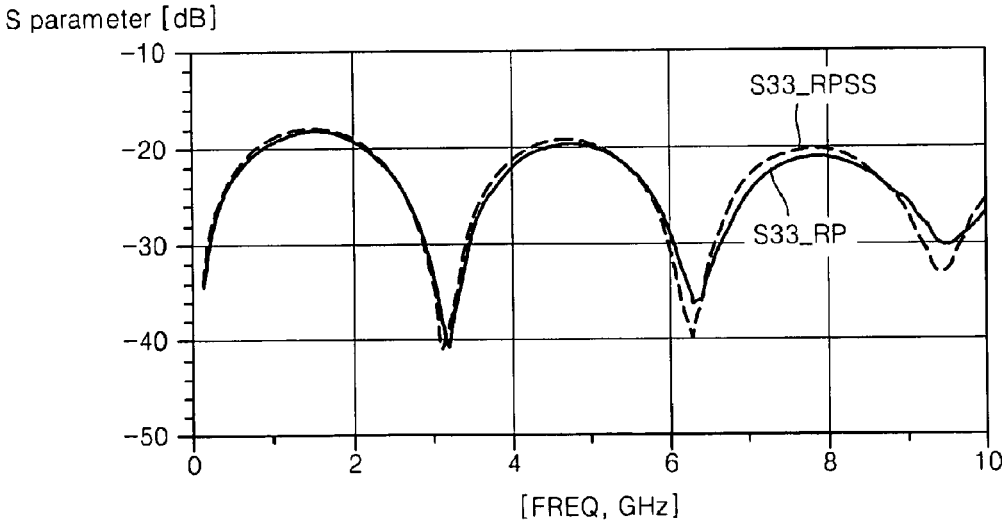
Figure 8C:
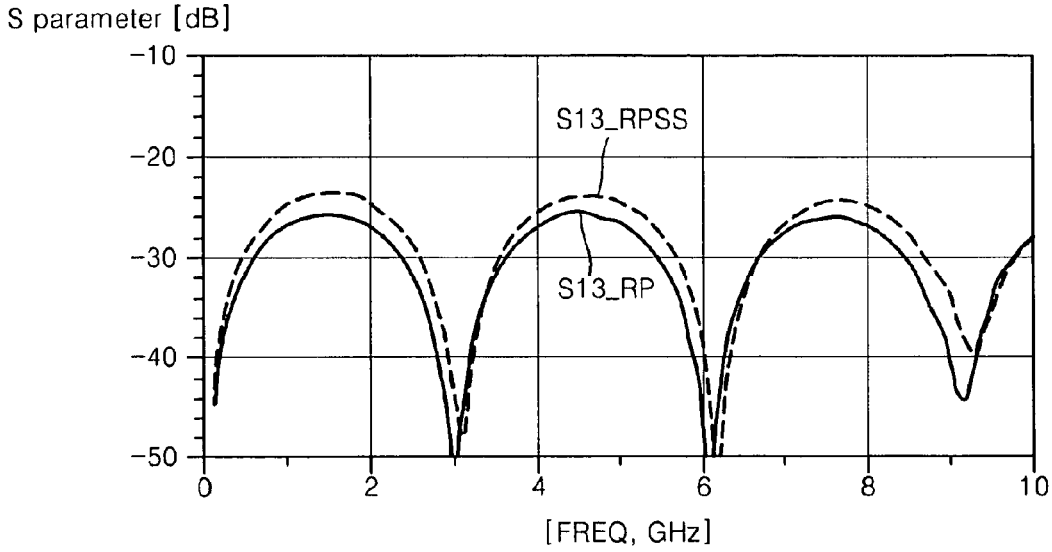
Figure 8D:
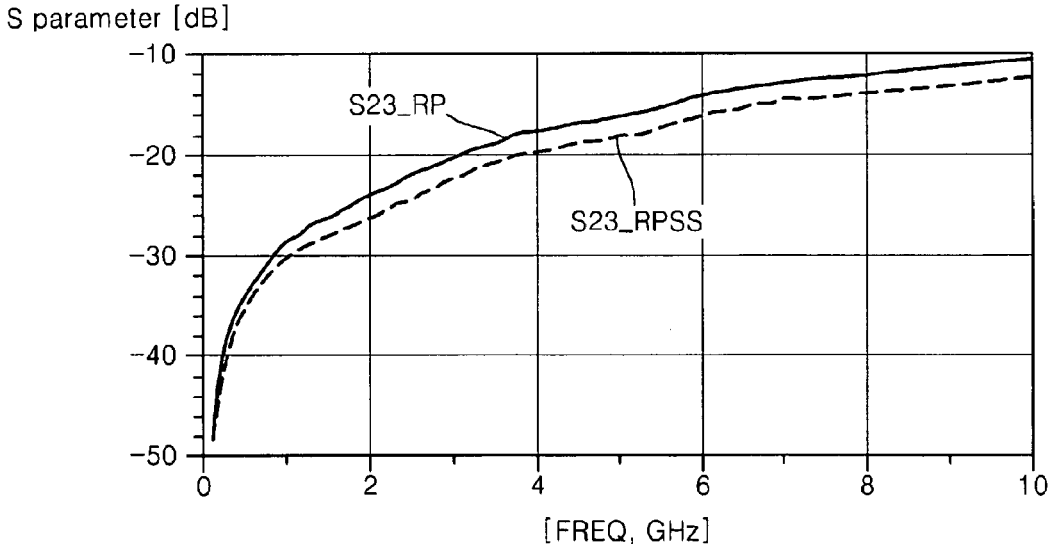

In FIGS. 8A, 8B, 8C and 8C, the S-parameters may represent the transmission characteristics of higher-frequency signal transmission circuits. For example, the signal transmission circuits may include three transmission ports 1T, 3T and 5T and three receiving ports 2T, 4T and 6T, as illustrated in FIGS. 7A and 7B. If a signal is transmitted from the transmission port 3T to the receiving port 4T, an S-parameter S43 representing transmission characteristics may be an index indicating a degree to which the signal input to the transmission port 3T is transmitted to the receiving port 4T as shown in FIG. 8A. An S-parameter S33 representing reflection characteristics may be an index indicating a degree to which the signal input to the transmission port 3T is reflected to the transmission port 3T as shown in FIG. 8B. An S-parameter S13 representing near end cross talk (NEXT) characteristics may be an index indicating a degree to which the signal input to the transmission port 3T affects the transmission port 1T as shown in FIG. 8C. An S-parameter S23 representing far end cross talk (FEXT) characteristics may be an index indicating a degree to which the signal input to the transmission port 3T affects the receiving port 2T as shown in FIG. 8D.

FIG. 8A illustrates an S-parameter S43_RP representing the S-parameter S43 of the reference transmission plane RP in FIG. 7A and an S-parameter S43_RPSS representing the S-parameter S43 of the reference transmission plane RPSS in FIG. 7B. FIG. 8B illustrates an S-parameter S33_RP representing the S-parameter S33 of the reference transmission plane RP in FIG. 7A and an S-parameter S33_RPSS representing the S-parameter S33 of the reference transmission plane RPSS in FIG. 7B. FIG. 8C illustrates an S-parameter S13_RP representing the S-parameter S13 of the reference transmission plane RP in FIG. 7A and an S-parameter S13_RPSS representing the S-parameter S13 of the reference transmission plane RPSS in FIG. 7B. FIG. 8D illustrates an S-parameter S23_RP representing the S-parameter S23 of the reference transmission plane RP in FIG. 7A and an S-parameter S23_RPSS representing the S-parameter S23 of the reference transmission plane RPSS in FIG. 7B.

Referring to FIG. 8A, the transmission characteristics of the signal transmission circuit including separation slots in FIG. 7B may be improved compared to the transmission characteristics of the conventional signal transmission circuit not including separation slots in FIG. 7A in a higher-frequency region. In contrast, the S-parameter S43_RP and the S-parameter S43_RPSS may be substantially similar in a lower-frequency region.

Referring to FIG. 8B, the reflection characteristics of the signal transmission circuit including separation slots in FIG. 7B may not substantially differ as compared to those of the signal transmission circuit not including separation slots in FIG. 7A.

Referring to FIG. 8C, the NEXT characteristics of the signal transmission circuit including separation slots in FIG. 7B may be slightly reduced as compared to the NEXT characteristics of the signal transmission circuit not including separation slots in FIG. 7A. However, a slight decrease in the NEXT characteristics need not be a problem because drivers for transmitting signals may be set at the transmission ports 1T, 3T and 5.

Referring to FIG. 8D, the FEXT characteristics of the signal transmission circuit including separation slots in FIG. 7B may be improved in a higher-frequency region as compared to the FEXT characteristics of the signal transmission circuit not including separation slots in FIG. 7A.

In another example embodiment of the present invention, cross-talk between neighbouring signal transmission lines may be reduced. In a further example, the transmission characteristics and FEXT characteristics of a signal transmission circuit may be improved.

Example embodiments of the present invention being thus described, it will be obvious that the same may be varied in many ways. For example, while FIGS. 5B, 5C, and 5D illustrate example shapes and numbers of separation slots, it is understood that other example embodiments of the present invention may be directed to any number and/or shapes of separation slots.

Such variations are not to be regarded as a departure from the spirit and scope of example embodiments of the present invention, and all such modifications as would be obvious to one skilled in the art are intended to be included within the scope of the following claims.

What is claimed is:

1. A signal transmission circuit, comprising:

a plurality of signal transmission lines, each of the plurality of signal transmission lines configured to transfer data via signal currents; and a reference transmission plane configured to transfer return currents corresponding to the signal currents, the reference transmission plane separated from each of the plurality of signal transmission lines by an insulating layer, the reference transmission plane including at least one separation slot, Such that respective paths for the transfer return currents are disposed in regions of the reference transmission plane that correspond only with each of the plurality of signal transmission lines, wherein the at least one separation slot is a removed portion of the reference transmission plane and the removed portion of the reference transmission plane is at least partially filled with a dielectric material.

2. The signal transmission circuit of claim 1, wherein the reference transmission plane is set to a given voltage with respect to the plurality of signal transmission lines.

3. The signal transmission circuit of claim 2, wherein the given voltage is one of a ground voltage and a power supply voltage.

4. The signal transmission circuit of claim 1, wherein the at least one separation slot has a given shape within the reference transmission plane.

5. The signal transmission circuit of claim 4, wherein the given shape is one of a polygonal shape, a circular shape and an oval shape.

6. The signal transmission circuit of claim 1, wherein each of the plurality of signal transmission lines is provided by one of a plurality of metal layers, and the reference transmission plane is provided by another one of the plurality of metal layers.

7. The signal transmission circuit of claim 6, wherein the plurality of signal transmission lines include a first signal transmission line transmitting a first signal current representing first data, the first signal transmission line being provided by the one of the plurality of metal layers, and a second signal transmission line transmitting a second signal current representing second data different from the first data, the second signal transmission line being provided by the one of the plurality of metal layers, and wherein the reference transmission plane transmits a first return current corresponding to the first signal current and a second return current corresponding to the second signal current, the reference transmission plane provided by the another one of the plurality of metal layers.

8. The signal transmission circuit of claim 7, wherein the at least one separation slot is configured to reduce cross-talk between the first and second signal transmission lines due to the first and second return currents.

9. The signal transmission circuit of claim 8, wherein a path of the first return current is disposed in a region of the reference transmission plane corresponding to the first signal transmission line, a path of the second return current is disposed in a region of the reference transmission plane corresponding to the second signal transmission line, and wherein the at least one separation slot includes a plurality of separation slots disposed in a region of the reference transmission plane positioned between and in parallel with the regions corresponding to the first and second signal transmission lines.

10. The signal transmission circuit of claim 8, wherein the at least one separation slot is a respective cutout in a metal layer defining the reference transmission plane and the dielectric material fills the entire removed portions.

11. The signal transmission circuit of claim 1, wherein the plurality of signal transmission lines are provided by a first of a plurality of metal layers, the reference transmission plane is provided by a second of the plurality of metal layers, and the at least one separation slot includes a plurality of separation slots disposed in parallel with neighboring signal transmission lines from among the plurality of signal transmission lines.

12. The signal transmission circuit of claim 11, wherein the plurality of separation slots are configured to reduce cross-talk between the neighboring signal transmission lines due to the return currents.

13. The signal transmission circuit of claim 11, wherein the plurality of separation slots are disposed in at least one of a plurality of rows, the at least one row in parallel with the neighboring signal transmission lines.

14. The signal transmission circuit of claim 11, wherein paths of the return currents are respectively disposed in regions of the reference transmission plane corresponding to the neighboring signal transmission lines, and the plurality of separation slots are disposed in a region of the reference transmission plane positioned between the regions corresponding to the neighboring signal transmission lines.

15. The signal transmission circuit of claim 11, wherein the plurality of separation slots are a respective cutout in the second of the plurality of metal layers defining the reference transmission plane.

16. The signal transmission circuit of claim 15, wherein the plurality of separation slots are filled with the dielectric material.

17. A signal transmission circuit, comprising:

a plurality of signal transmission lines, each of the plurality of signal transmission lines configured to transfer data via signal currents; and a reference transmission plane configured to transfer return currents corresponding to the signal currents, the reference transmission plane separated from each of the plurality of signal transmission lines by an insulating layer, the reference transmission plane including at least one separation slot, wherein the plurality of signal transmission lines include first and second signal transmission lines provided by a first metal layer and third and fourth signal transmission lines provided by a second metal layer, and wherein the reference transmission plane is a common reference transmission plane provided by a third metal layer and positioned between the first and second metal layers, the at least one separation slot being a plurality of common separation slots positioned within the common reference transmission plane at regions respectively located between a region corresponding to the first signal transmission line, a region corresponding to the second signal transmission line, a region corresponding to the third signal transmission line and a region corresponding to the fourth signal transmission line.

18. The signal transmission circuit of claim 17, wherein the common reference transmission plane is set to a given voltage with respect to the first, second, third and fourth signal transmission lines.

19. The signal transmission circuit of claim 18, wherein the given voltage is one of a ground voltage and a power supply voltage.

20. The signal transmission circuit of claim 17, wherein a path of a return current corresponding to a first signal current transmitted through the first signal transmission line is disposed in the region of the common reference transmission plane corresponding to the first signal transmission line, a path of a return current corresponding to a second signal current transmitted through the second signal transmission line is disposed in the region of the common reference transmission plane corresponding to the second transmission line, a path of a return current corresponding to a third signal current transmitted through the third signal transmission line is disposed in the region of the common reference transmission plane corresponding to the third signal transmission line, and a path of a return current corresponding to a fourth signal current transmitted through the fourth signal transmission line is disposed in the region of the common reference transmission plane corresponding to the fourth signal transmission line.

21. The signal transmission circuit of claim 20, wherein the common separation slots are configured to reduce cross-talk between the first and second signal transmission lines caused by the return current corresponding to the first signal current and the return current corresponding to the second signal current and cross-talk between the third and fourth signal transmission lines caused by the return current corresponding to the third signal current and the return current corresponding to the fourth signal current.

22. The signal transmission circuit of claim 17, wherein the common separation slots are a respective cutout in the third metal layer defining the common reference transmission plane.

23. The signal transmission circuit of claim 22, wherein the common separation slots are filled with a dielectric substance.

24. A method of forming a signal transmission circuit, comprising:

forming a plurality of signal transmission lines, each of the plurality of signal transmission lines configured to transfer data via signal currents; and forming a reference transmission plane configured to transfer return currents corresponding to the signal currents, the reference transmission plane separated from each of the plurality of signal transmission lines by an insulating layer, the reference transmission plane including at least one separation slot, such that respective paths for the transfer return currents are disposed in regions of the reference transmission plane that correspond only with each of the plurality of signal transmission lines, wherein the plurality of signal transmission lines are formed from a first metal layer and the reference transmission plane is formed from a second metal layer, and the at least one separation slot of the reference transmission plane is formed by removing a portion of the second metal layer and by at least partially filling the removed portion with a dielectric substance.

* * * * *